United States Patent [19]

Ervin, Jr.

[11] Patent Number: 4,646,818

[45] Date of Patent: Mar. 3, 1987

[54] HEATED MATS FOR MELTING SNOW AND ICE FROM OUTDOOR SURFACES

[76] Inventor: Essie Ervin, Jr., 1832 N. Hanley Rd., St. Louis, Mo. 63114

[21] Appl. No.: 625,696

[22] Filed: Jun. 28, 1984

[51] Int. Cl.[4] ..... F28F 27/02

[52] U.S. Cl. ..... 165/703; 165/45; 165/46; 237/69; 126/271.1

[58] Field of Search ..... 126/271.2 A, 271.1; 237/1 R, 69, 56, 8 R; 165/45, 35, 103

[56] References Cited

U.S. PATENT DOCUMENTS

| | | | |
|---|---|---|---|
| 223,784 | 1/1880 | Watson | 237/1 R X |
| 246,773 | 9/1881 | Hill | 165/103 |
| 303,164 | 8/1884 | Jennings | 165/35 X |
| 452,504 | 5/1891 | Bottsford | 237/56 |
| 1,203,179 | 10/1916 | Bowles | 126/271.2 A |
| 2,743,057 | 4/1956 | Backstrom | 237/69 |
| 3,410,977 | 11/1968 | Ando . | |
| 3,568,924 | 3/1971 | Chenault | 237/1 R |
| 3,683,152 | 8/1972 | Laing et al. . | |
| 3,758,748 | 9/1973 | Reid . | |
| 3,818,892 | 6/1974 | Kohorn | 237/1 R X |
| 3,958,754 | 5/1976 | Newcomb et al. | 237/1 R |
| 3,993,122 | 11/1976 | Svenstam | 126/271.2 A X |
| 4,011,989 | 3/1977 | Diggs | 237/69 X |
| 4,159,595 | 7/1979 | Dalle et al. . | |
| 4,270,596 | 6/1981 | Zinn et al. . | |

FOREIGN PATENT DOCUMENTS

| | | | |
|---|---|---|---|
| 1292634 | 3/1962 | France | 237/56 |
| 2278042 | 2/1976 | France | 237/69 |
| 0033344 | 3/1977 | Japan | 237/69 |
| 691882 | 5/1953 | United Kingdom | 237/69 |

*Primary Examiner*—William R. Cline

*Attorney, Agent, or Firm*—Milton S. Gerstein

[57] ABSTRACT

A device for melting snow and ice from outdoor surfaces is disclosed in which a plurality of mats are provided. Each mat includes lengths of hose tubing in which flows a warmed mixture of water and antifreeze, which mixture is heated by a heating unit operatively connected with the mats through appropriate supply and return lines. The mats themselves are grouped into three classes: Driveway mats, walkway mats, and sidewalk mats, all of which may be arranged to adapt to many different outdoor surface configuration. Most of the mats are also provided with a set of three valves which are used to control the flow of mixture, so that mats down-line may either be supplied with the mixture or may be cut off from it, so that selected surface areas may be warmed to have the snow and ice thereon melted. Each mat is further comprised of an upper mat portion and a lower mat portion, where each portion is made up of three separate layers designed to conserve as much heat energy as practicable.

3 Claims, 9 Drawing Figures

WATER HEATER
ON OFF
FULL
80
60
40
30
E
TEMP
M
H
XH
L 56
50
10
28
30
38
34
42
90
92
90'
82
58"
50'
74
76
80
96
94
96'
48
94'
92'
56'

27"
26'
27

27"
26'
27
27'

12
24
22
26'
14'
16
21
24'
14
22'
12'
21'

HEATED MATS FOR MELTING SNOW AND ICE FROM OUTDOOR SURFACES

BACKGROUND OF THE INVENTION

The present invention is directed to a device for melting snow and ice on outdoor surfaces, such as driveways, walkways, and sidewalks in a selective and controllable manner. Examples of prior art devices are disclosed in U.S. Pat. Nos.: 3,410,977; 3,683,152; 3,758,748; and 4,159,595. U.S. Pat. No. 4,270,596 discloses a mat heating device for use in radiating heating systems. These prior art devices allow for warming of surfaces, but are impractical in use, and do not allow for adapation to many differently-shaped road surfaces and configurations of outdoor surfaces.

It is well-known that deposits or ice or snow or deiveways, sidewalks, and walkways cause not only danger and hardship to pedestrians and automobiles, but also cause hardship in the removal of the snow or ice from the surface, if possible. It would, therefore, be highly beneficial to provide a device for melting the snow or ice from the outdoor surface in an easy, safe, and economical manner. However, since the shape and sizes of roadways, walkways, and sidewalks vary from site to site, it has been hitherto impractical to provide a device that can melt snow or ice from the surfaces and still be adaptable to all locations and sites where snow and ice need to be removed.

It has also been a problem that in order to melt the snow or ice and to prevent its re-formation on the outdoor surface, great expense has been required due to the high energy use supplied to the device for melting the snow and ice, whether such energy be in the form of electric, chemical, and the like.

SUMMARY OF THE INVENTION

It is, therefore, the primary object of the present invention to provide a snow-melting and ice-melting system that may be used and readily adaptable to many kinds and shapes of outdoor surfaces, such as driveways, walkways, and sidewalks, and which may be readily adaptable to all kinds of contours thereof.

It is another object of the present invention to provide a system for melting snow and ice on outdoor surfaces such that portions of the outdoor surface may be selectively and controllably warmed to melt the snow and ice or to prevent formation thereof, so that only selected areas of the outdoor surface are warmed, thus saving not only energy and expense, but allowing for sequential additions to the already-existing system for larger surface areas.

It is still a further object of the present invention to provide a system for melting snow and ice, and for preventing the formation thereof on an outdoor surface, where a plurality of detachable mats form the system, where each mat is made of a multi-layered upper and multi-layered lower mat surface portion designed to release heat at a steady and time-controlled rate to conserve as much energy as possible.

To these above-ends, the system of the present invention is comprised of a plurality of mats which are connectable together in a piece-by-piece fashion, so that the mats may be so contoured as to adapt to the shape, contour, length, and width of an outdoor surface which is to be warmed for melting snow and ice. There are provided in the system of the present invention basically three classes of mats: Driveway mats, walkway mats, and sidewalk mats. The driveway mats are comprised of three types: The main mat, extension mats, and end mat. The main mat is connected to the supply line and return line of a heating unit that warms a mixture of water and antifreeze, which mixture is pumped through the system of mats. The extension mats allow for increasing the length of the driveway mats system to accomodate longer driveways. The end mat closes off the driveway-mat array. Each type of mat is provided with loops of hose tubing through which the warm mixture of water and anti-freeze flows for heating the mats and melting snow and ice. The first two types of mats—the main mat and the extension mats—are provided with a set of three valves, arranged in triangular formation, to control the flow of the mixture and to shut off flow to any subsequent mat, so that either shorter or longer lengths of driveway road surface may be warmed, depending upon the conditions prevailing. The end mat is not provided with valves. Each of the three types of driveway mats is also further provided with an inlet line and an outlet line, each of which is comprised of a multitude of T-section pipes for easy connection, and disconnection and removal. The T-section pipes allow, among other things, for the connection of another array such as a sidewalk array, or even another driveway array to accomodate very wide driveways, to the driveway array, so that the same warm mixture of water and antifreeze may be used to warm a sidewalk or walkway.

Each of the other two classes of mats—the sidewalk mats and the walkway mats—includes an end mat, and a series of extension mats, with each extension mat also including a triangular arrangement of valves. These two classes of mats are usable by connecting the first extension mat thereof to one of the driveway mats to direct the flow of warm mixture to the subsidiary array. Connection between arrays is achieved by connecting the inlet and outlet of the first extension mat of the subsidiary array to the outlet line of one of the driveway mats. Each of the inlet line and the outlet line of each of the two subsidiary arrays may be interchanged, so that both left-handed and right-handed types of contoured outdoor surfaces may be accomodated. Further, at least one of the walkway extension mats is generally provided in a curved contoured shape to adapt to a curved outdoor surface. Typically, the curvature is ninety degrees, though different angular extensions are possible.

Each mat of the three classes is provided with an upper mat surface having an upper layer or tarp, or the like, with a middle layer of continuous plastic, and a lower layer of apertured insulation. Each mat further has a lower mat surface having a top layer of insulation, a middle layer of continuous plastic, and a lower layer of tarpaulin, or the like. The upper and lower mat surfaces are stitched together along appropriate lines and curves to establish a partially-concentric arrangement of passageways in which are provided the loops of hose tubing through which the warmed mixture of water and antifreeze flows. Each mat is also provided with a third supplemental mat surface connected at its two end surfaces to the ends of the upper and lower mat surfaces, which third mat covers and protects the inlet and outlet lines of the mat, which lines are adjacent to the ends of the upper and lower mat surfaces connected to the end surfaces of the third mat surface.

BRIEF DESCRIPTION OF THE DRAWING

The invention will be more readily understood with reference to the accompanying drawing, wherein FIG. 1 is a plan view showing the main mat of the present invention for warming the upper surface of a driveway and the like;

FIG. 4 is a schematic showing a plurality of extension mats combined with the main mat to form a linear series for warming a length of outdoor surface, along with an end mat similar to the main mat but without valves;

FIG. 5 is a side view showing the heating device and storage tank for the mixture of water and antifreeze that flows through the mats of the present invention;

FIG. 7A is a side view showing a stake used to hold the mats down to the outdoor surfaces; and FIG. 7B shows another stake having a rounded hook portion.

DETAILED DESCRIPTION OF THE INVENTION

Figures 1, 4, 5, 7A, 7B:
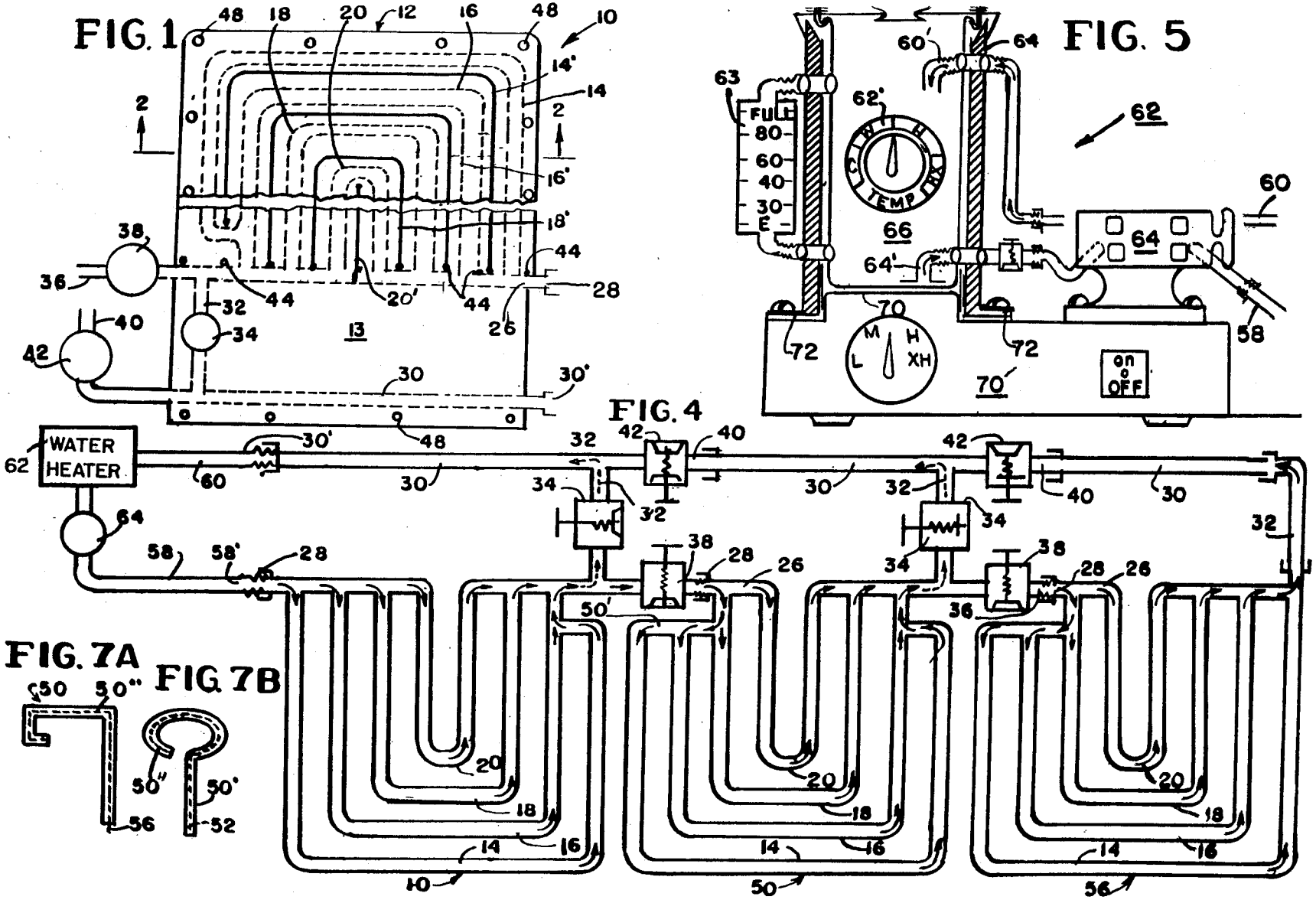

Referring now to the drawing in greater detail, and in particular to FIG. 1, there is shown a main driveway mat 10 of the present invention used to warm outdoor surfaces, such as a driveway, though it may by used for direct placement on any kind of outdoor surface, such as a sidewalk or walkway, whereby snow and ice may be melted for subsequent removal. The main mat 10 may be used initially to prevent the formation of ice and snow or may be used to melt snow or ice already present. The main mat 10 is a foldable or rollable tarpaulin-like member in which an upper mat surface portion and a lower mat surface portion sandwich therebetween a plurality of hose tubing passageways. In FIG. 1, the upper mat surface portion 12 is shown, with the hose tubing indicated in dashed lines. As clearly shown in FIG. 1, the hose tubing is made up of a plurality of partially-concentric loops 14, 16, 18, and 20. Only four such loops are shown in FIG. 1, but it is to be understood that more such loops may be provided in similar fashion. Further, it is within the scope and spirit of the present invention that, instead of partially-concentric loops of hose tubing, spiral or other configurations may be utilized. Further, the spacing between parallel portions of the loops may be so adjusted as to ensure maximum warming of surfaces.

Figures 2, 3A, 3B, 6:
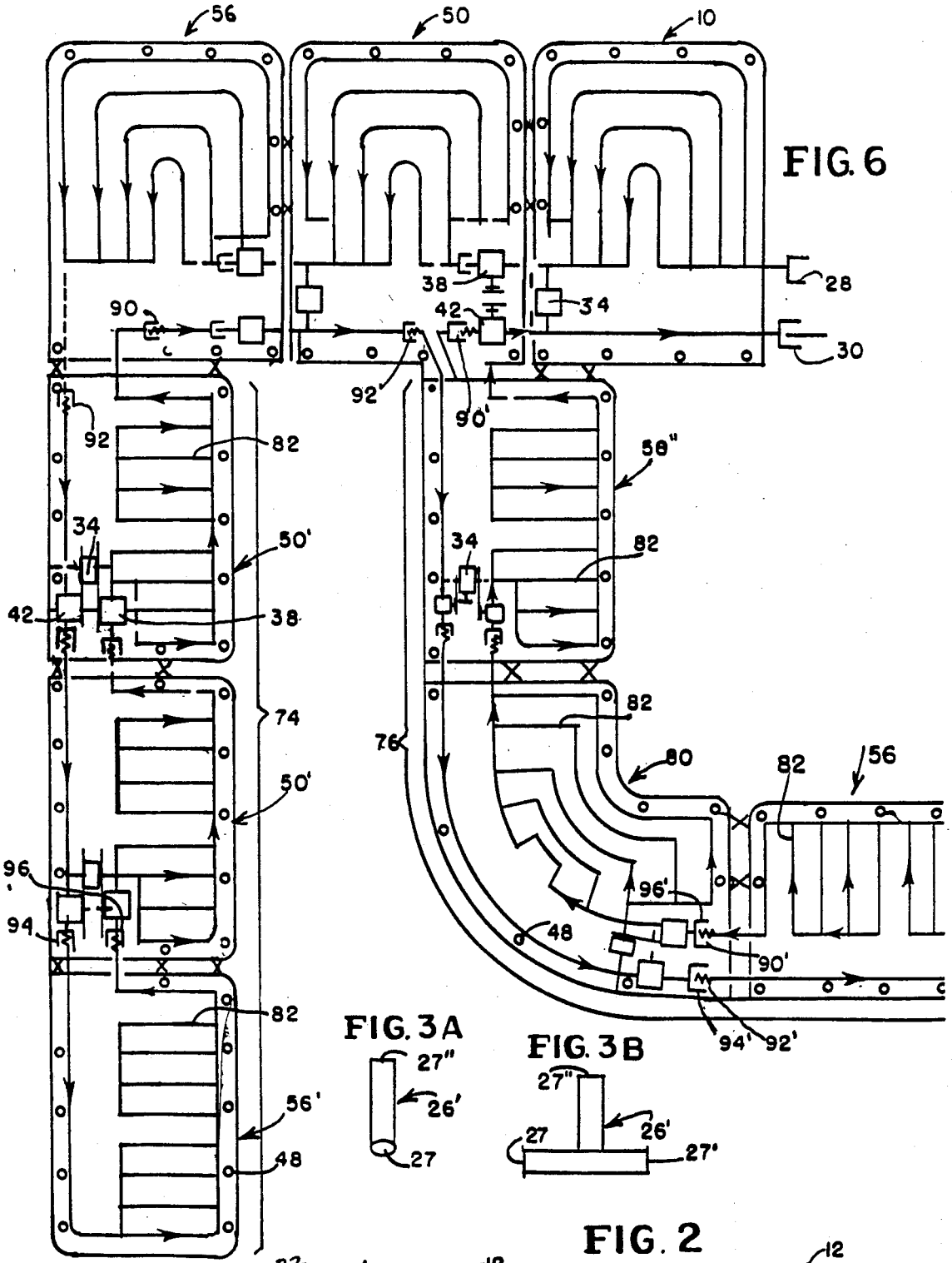
FIG. 2 is a cross-sectional view taken along line 2—2 of FIG. 1 showing the construction of the upper and lower mat surface portions of the main mat of the present invention, which construction applies to all of the mats of the present invention.
FIG. 3A is an end elevational view showing one of the T-section pipe forming the inlet line and the outlet line of each mat of the present invention.
FIG. 3B is a side view of the T-section pipe of FIG. 3A.
FIG. 6 is a schematic showing a plurality of mats of the present invention adapted to the outdoor surfaces of a driveway, sidewalk, and walkway for warming the outer surfaces thereof to melt snow and ice thereon where the same warm mixture of water and antifreeze is used to flow through each and every mat that is warmed.

The solid lines in FIG. 1, running parallel to the dashed lines, indicated by 14', 16', 18', and 20', depict the lines where the upper mat surface portion 12 is stitched to the lower mat surface portion 12' (see FIG. 2). The stitch lines shown in FIG. 1 define the actual closed path or passageways in which the hose tubings are positioned. In the construction of the mat of FIG. 1, the stitch lines 14'–20' are preferably formed first with the hose tubings inserted thereafter, though the opposite may be done where the hose tubings are first placed between the upper and lower mat surface portions and the stitching around the outer limits of the hose tubing loops to fixedly attach portions of the upper mat surface portion with portions of the lower mat surface portion being carried out thereafter.

FIG. 2 shows in detail the construction of the main mat 10, and the upper mat surface portion 12 and lower mat surface portion 12'. The upper mat surface portion 12 is comprised of three separate layers that are stitched, or otherwise bonded together. The first topmost layer 22 is a layer of tarpaulin. The middle layer of the three layers is a layer of continuous plastic 24. The third, lower-most layer of the three layers is an apertured pad 26 lying directly on the tubing itself. The apertures of the lower layer 26 provide for slow, timed release of heat from the tubing to the mat surface.

The lower mat surface portion 12' includes a lowermost layer of tarpaulin 22', with a middle layer 24' of continuous plastic without apertures formed therein, and a third uppermost layer of another insulating material without apertures directly beneath the tubing. Adjacent concentric passageways are joined as described above, as shown by reference numeral 14' in FIG. 2, which refers to the stitch line shown in FIG. 1. The ends of the upper and lower mat surface portions 12,12' are also stitched, or otherwise fastened together, so as to define sealed-off edges 21,21', so that the outer hose tubing loop is sealed along the outer surface thereof facing away from the other hose tubings. The upper and lower mat surface portions are so stitched together along appropriate lines such that the hose tubings forming the loops 14–20 are not squeezed to any great extent, so as to preclude any deformation of the hose tubing in a way that would close off passage of the mixture of water and antifreeze therethrough. Thus, sufficient clearance is provided for insertion of the tubing. It can, therefore, be seen that upon flow of a warmed mixture of water and antifreeze through the hose tubings, both the upper and lower mat surfaces will be warmed, with the upper mat surface portion 12 being warmed to a greater extent than the lower mat surface portion 12' since the upper mat surface portion includes the apertured layer 24. This ensures that most of the heat produced within the tubing is released upwardly to the upper mat surface portion upon which rests snow and ice. However, the lower mat surface portion will still be warmed to provide small amounts of heat energy to the upper surface of the outdoor surface to melt snow and ice already thereon and to prevent formation thereof.

The materials used for each of the layers described above are those best suited to the function to be carried out. Any wellknown insulating material may be used for the insulating layers. The thickness of each layer may be equal, though it is to be understood that the thicknesses thereof may differ. Differences in the thicknesses will depend upon the materials used in the construction and heat generated by the flowing mixture, as well ambient conditions. The two outer layers of the mat are, however, preferably made of tarpaulin.

Referring now to FIG. 1, the main mat 10 is also provided with an inlet line 26 through which the heated mixture of water and antifreeze flows to the hose tubing loops. The loop 20 forms part of the inlet line 26. The inlet line 26 is made up to a number of T-section pipes 26', as shown in FIGS. 3A and 3B. The T-section pipe shown has a pair of end openings 27, 27' through which the mixture flows, and a central opening 27" which is connected to an end of one of the tubing loops 14–20. Adjacent ends of the T-section pipes are interconnected by short hoses clamped to the ends of the T-section pipes, while the central opening 27" is connected to an end of a tubing loop also by a clamp. As is evident in FIG. 1, the stitch lines 14'–20' terminate adjacent respective ends of the T-section pipes, where the ends are connected by a short hose clamped to the ends. Thus, as the mixture flows through the inlet line 26 from inlet 28 thereof, it also branches off into the plurality of tubing loops 14–20, whereafter the mixture again returns to the inlet line 26 at the ends of the tubing loops 14–20 remote from the inlet 28. Elbows are used in the inlet line where it turns to form the loop 20.

The main mat 10 is provided with an outlet line 30 in which the mixture from the inlet line flows afer passage through the tubing loops. The outlet line 30 is in fluid communication with the inlet line 26 via a connecting branch 32, as shown in FIG. 1. The connecting branch 32 is provided with a valve 34 which, when opened, allows flow of the mixture from the end of the inlet line to the beginning of the outlet line, as is evident from FIG. 1. When the valve 34 is closed, flow is stopped. The end of the inlet line 26 is provided with an end extension 36 having a valve 38 positioned thereat for controlling the flow of the mixture therethrough. The outlet line 30 is also provided with a connecting extension 40 having a valve 42 positioned thereat to control the flow of the mixture therethrough. Thus, the three valves 34, 38, and 42 provide a multidirectional control for the flow of the mixture, whereby the mixture may be directed along desired paths, which has importance when a plurality of mats are arranged in series in order to warm a surface area. If it is desired to prevent any flow of warm mixture through the tubing loops of the mat 10, then valves 38 and 34 are closed, which, in effect, puts the mat 10 out of service. If only the mat 10 shown in FIG. 1 is used, or if it is desired to prevent the flow of warm mixture from the mat 10 to another mat connected to the mat 10 via the lines 36 and 40, the valve 38 is closed and the valve 40 is closed, while the valve 34 is opened, thus directing the flow of mixture directly from the inlet line 26 to the outlet line 30. If, as will be described below, it is desired to furnish another mat connected to the mat 10 with the warm mixture, then the valves 38 and 40 are opened, and the valve 34 closed, thus directing the flow from the inlet line 26 through the extension 36, to the adjacent mat having its inlet 28 connected to the extension 36, through the hose tubing of that adjacent mat, and from there to the outlet line 30 of the adjacent mat, and thence to the outlet line 30 of the mat 10 through the extension 40.

It is noted that the mat 10 is provided with one additional mat surface, indicated by reference numeral 13 in FIG. 1. The supplemental mat surface 13 is used to cover and protect the inlet line 26 and the outlet line 30, along with the valve 34 and line 32. The supplemental mat surface 13 is constructed of the same material and layers as the lower mat surface portion 12', and has a first end edge fastened to the end of the upper mat surface portion 12 at the end thereof adjacent the inlet line 26, as shown by reference numerals 44. The other end edge of the supplemental mat surface is attached to the end of the lower mat surface portion 12' directly below the end of the upper mat surface portion 12 that is fastened to the first end edge of the supplemental mat surface. Thus, the supplemental mat surface extends from the end of the upper mat surface portion 12 directly adjacent the inlet line 26, over the inlet 26 and over the connecting line 32, over and around the outlet line 30, and then under the outlet line 30, and under the connecting line 32 and under the inlet line 26, to the end of the lower mat surface portion 12' adjacent the inlet line 26. Thus, the lines 26, 30, and 32 are covered and protected, and these lines are also held in place and attached to the upper and lower mat surface portions 12, 12' in a fixed position relative thereto. The supplemental mat surface may be joined to the upper and lower mat surface portions by stitching, or snaps, or any other conventional fastening technique. Initially, in forming the mats, each of the upper, lower, and supplemental mat surface portions are cut at their four corners with a diagonal cut, so that the four sides thereof may be turned down to form three side walls extending about the outer circumference of the mat. The three downturned sides of the upper and lower mat surfaces may be stitched or otherwise fastened to each other along the three sides thereof to form three side walls of the mat, not including the ends of the mat portions to which the inlet line is directly adjacent. The inlet side edges of the upper and lower mat surface portions are indirectly joined together by the supplemental mat surface 13, as described above. In order to ensure that the mat itself has the side walls covering the outer tubing loop, as indicated by reference numerals 21 and 21' in FIG. 2, each side of each mat surface is provided with at least one inch of material more than needed to span the tubing loops, which provides for a surplus of material that can be cut along the diagonal line, so as to be downturned to constitute the side walls of the mat that are stitched or otherwise fastened together.

The mat 10 is also provided with a series of circumferential holes 48 through which stakes 50 or 50', shown in FIGS. 7A and 7B, respectively, may be inserted for firmly anchoring the mat to the ground, in those cases of windy conditions or excessive incline of the outdoor surface. The stake has a hook portion 50" for engaging the tops of the mat surface, and an inserting peg portion 52 for insertion into the ground, where conditions allow. The hooks 50" may also be used to attach the stake to an appropriate anchoring point above the ground if possible.

Referring now to FIG. 4, a plurality of mats are shown connected together to form an enlarged surface area. In the example shown in FIG. 4, three mats are used and arranged in a linear array. The first mat 10 is the same as that shown in FIG. 1. The second mat is an extension mat 50 identical to mat 10 with the exception that the inlet ends of the three outer tubing loops 14, 16, and 18 are connected to a common manifold 50'. The common manifold 50' is provided for the mat 50 in order to accomodate the connection of the valve to the inlet 28 of the inlet line 26 of the second extension mat 50. This ensures that the space between the outer adjacent circumferences of the outer-most tubing loops 14 of the first main mat and the second extension mat 50 are not too far apart, so that the heat from the mats is provided along the outdoor surface at portions thereof that are not spaced too far apart, so that all areas of the outdoor surface are provided with heat to melt the snow or ice. As shown in FIG. 4, the two adjacent outer loops 14 are spaced from each other at their adjacent portions about the same distances as the concentric tubing loops themselves are spaced from each other along the lengths thereof in each mat. The solid arrows in FIG. 4 show the path of the mixture, while the dashed arrow lines indicate the possible alternative re-routing of the flow path via the valves.

The inlet 28 of the extension mat 50 is attached, as by clamping, to the end extension 36 of the inlet of the main mat 10, while the end extension 36 of the extension mat is itself attached to the inlet of an end mat 56. The outlet lines of the three mats are similarly connected as shown. The end mat 56 is similar in construction to the extension mat 50, with the exception that there are no valves provided in the end mat 56, and, therefore, no line extension 36 and 40. While only one extension mat 50 has been shown in FIG. 4, it is to be understood that any number of these extension mats may be provided and attached in series as shown, with each extension mat being attached to at least one other extension mat, with the last extension mat being connected at one end to the main mat 10 or the end mat 56. It is also emphasized that since the inlet line 26 and outlet line 30 are comprised of detachable T-section pipes, it is possible to connect other mats to either of these lines at any appropriate point along these lines, as will become more clear when discussing the arrangement of FIG. 6. Further, connecting line 32 is also made of detachable T-section pipes, as indicated in end mat 56, which allows for right angle connection of mats, which will also become more evident with discussing the arrangement of FIG. 6.

The valves of the mats of FIG. 4 may be used to allow the flow of warm mixture either through the main mat only, through the main mat and extension mat 50, or through all three mats including the end mat 56. In the first case, when only using the main mat 10, the valves 38 and 42 of the main mat are closed, with the valve 34 opened. In the second case, with flow through the first two mats, the valves 38 and 42 are opened, and the valve 34 closed in the main mat 10, while the valves 38 and 42 of the extension mat are closed with the valve 34 opened. In the third case, both valves 34 of the first two mats are closed, while all others are opened. In the case of additional extension mats 50, similar operation of the valves is employed.

The arrangement shown in FIG. 4 is utilized where the driveway road surface is straight. However, the present invention is capable of use with curved surfaces, or surfaces extending at right angles to a straight surface, as will be discussed below in greater detail, in reference to FIG. 6.

The main mat 10 receives the flow from a supply hose line indicated generally by reference numeral 58 in FIG. 4. The end 58′ of the supply line 58 is clamped to the inlet 28 of the inlet line of the main mat 10. The outlet end 30′ of the outlet line 30 of the main mat 10 is clamped to the end 60′ of the return hose line 60. A heating unit 62, shown schematically in FIG. 4, heats the mixture of water and antifreeze to a desired workable temperature, which heated mixture is then supplied to the inlet of the main mat via pump 64.

FIG. 5 shows the heating unit 62, which includes a storage tank 66 having a conventional temperature gauge 62′ and water level indicator 63 associated therewith. The storage tank is surrounded by an insulating shell 64 of suitable insulating material. The return line 60 has an end clamped to the storage tank, a portion 60′ of which extends through the storage tank into the interior thereof, as shown in FIG. 5, at the upper portion of the tank. The supply line is shown connected to the pump 64 at one end thereof, while the other end of the pump is fluidly connected to the interior of the storage tank 66 via hose line 64′. The storage tank 66 is supported on a conventional heating plate 70 raised a few inches above the top plane of the operating unit thereof. The heating plate supplies the heat to the tank to warm the mixture. The insulating shell 64 is attached to the operating unit 70′, as by screws 72. The storage tank is also provided with a conventional pressure release cap.

Referring now to FIG. 6, there is shown an arrangement by which the mats of the present invention may be used to melt snow and ice upon a driveway-walkway and driveway-sidewalk arrangement. This is given only by way of example, since it possible to adapt the mats of the present invention to many different types of arrangements. The first three mats of FIGS. 6, 10, 50, and 56, can clearly be seen to constitute the array of FIG. 4, with the main mat 10 providing access to the supply and return lines. These first three mats operate in the same manner as described above. In addition, to these three mats in linear array, there are also provided two additional arrays: Another linear array 74 for a sidewalk, and a curved contoured array 76 for a walkway. The straight array 74 is provided with two sidewalk extension mats 50′ arranged in series as shown, and an end sidewalk mat 56′, arranged in series with the sidewalk extension mats. The first of the sidewalk extension mats 50′ of the array 74 is fluidly connected to the end mat 56 of the first straight array by connecting the connecting pipe 32 of the end mat 56 to the outlet 40 of the extension mat 50′ of the second straight array 74. This is easily accomplished since the lines of the mats are made up of detachable T-section pipes and elbows. The inlet 28 of the extension mat 50′ of the straight array 74 is in fluid connection with the outlet line 30 of the extension mat 56 of the first straight array, as shown in FIG. 6. Thus, the outlet of the sidewalk extension mat of the straight array 74 serves, in this instance, as the inlet through which the heated water mixture enters from the end mat 56 of the first straight array. From there, the flow can be controlled by the valves of the extension mats 50′ of the array 74, in the same manner as it is controlled in the first straight array of FIG. 4. In may, therefore, be seen that the three cases of flow of the mixture may be likewise achieved as in the first straight array. Only the outlets and inlets have been reversed. This reversal allows for alignment of the edges of the mats 50′,50″, and 56′ with the edge of the end mat 56 of the first straight array. Of course, it is possible to connect the inlets of the mats 50′, 50″, and 56′ to the inlet of the end mat 56, though alignment of the edges may not result. Further, it is possible to criss-cross the connection of the outlet of the end mat 56 with the outlet and inlet of the sidewalk extension mat 50′, so that the inlet of the mats perform in their normal fashion as those of FIG. 4. This is easily accomplished by the use of hoses connecting the end mat outlet line with the outlet and inlet of the extension mat 50′ of the array 74, the hoses allowing for easy manipulation. It is also noted that when the mixture is supplied to the end mat 56, such mixure is automatically supplied to the first extension mat of the array 74.

The other curved walkway array 76 is similar to the array 74 with the exception that the second walkway extension mat 80 is a curved contoured mat curved to adapt to the shape of the curved surface. Further, the first walkway extension mat 50'' of the array 76 is connected to the outlet line 30 of the extension mat 50 of the first straight array, such that both the outlet and inlet of the mat 50'' are connected to the outlet 30 of the extension mat of the first straight array.

The arrangement of FIG. 6 may be readily rearranged to conform to a left-handed curved contour, where the curvature is to the left rather than to the right. All that need be done is to simply flip over all of the mats 180 degrees to provide a mirror image of that shown in FIG. 6. It is clear that any number of designs and configurations may be achieved to conform to any number of road shapes and designs and configurations. In so doing, it is to be borne in mind that each of the main mats and straight extension mats, curved extension mats, and end mats may be used either with the inlet acting as the inlet, in the manner of FIG. 4, or with the inlet acting as the outlet and the outlet as the inlet, in the manner of the mats of the arrays 74 and 76 of FIG. 6. This provides great flexibility in adapting the mats to road surfaces. Further, owing to the triangular arrangement of the valves in the mats, exclusive of the end mats, control of the flow of the mixture is controllable regardless of which mode of operation the mats are under. Thus, the mats of the present invention are evertable, adding to the scope of conformable contours coverable with the mats.

It is noted that the connection between the extension mat 50' of the array 74 and the end mat 56 is accomplished via an opening formed in the supplemental mat suface 13 of the end mat adjacent the outlet line 30 of the end mat 56. Similarly, the extension mat 50 is also provided with an enlongated opening or cut-out portion in its supplemental mat surface 13 for passage of hose connections to the outlet and inlet of the extension mat 50'' of the array 76. Such a cut-out or opening is preferably a re-closable opening, such as by using snaps, and it is preferable that all of the mats are so provided with re-closable openings in their supplemental mat surfaces adjacent the outlet lines thereof.

The mats of the sidewalk array 74 differ slightly from their counterparts in the driveway array 10, 50, and 52, in that the sidewalk mats 50' and 56' are generally more rectangular in shape and generally comprise more tubing. The mats shown in FIG. 6 are shown only schematically, and it is to be understood that the tubing of the mats, indicated generally by reference numeral 82 for all of the mats of the arrays 74 and 76, may be arranged in concentric loop-type fashion, as the mats 10,50, and 56, or may be provided with other formations, such as the ones shown in FIG. 6, which are shown only by way of example. It is further noted that the sidewalk extension mat 50', the walkway extension mat 50', and curved walkway extension mat 80 differ in one other respect from the driveway extension mats in that the triangular arrangement of the valves 34, 38, and 40 do not extend outwardly beyond the periphery of the mat, which occurs with the extension mats 50 and main mat 10, but remain within the perimeter thereof such that the outer tubing lies directly adjacent thereto. This allows for the ends of the extension mats of the arrays 74 and 76 to be flipped end-to-end, so that control of first extension mats 50' and 50'' may be provided to prevent flow into the first mat of the arrays 74 and 76 from the end mat 56, if it is desired to have no flow whatsoever into the arrays 74 and 76. Thus, the sidewalk mats and the walkway mats are capable of eversion and also capable of inversion where the end of the mat having the triangular arrangement of valves thereat is flipped so as to constitute the end of the mat connected to the mat directly preceding it. Further, as described above, all mats are operable reversibly so that the valves allow for control regardless of which line is used as the inlet and which as the outlet.

It is again stressed that the inlet 90 and outlet 92 of the mats of the sidewalk array 74 are shown to be operated in reverse, though it is possible to use them in their other mode. Similarly, the inlet 90' and outlet 92' of the walkway array 76 may be used in reverse order or in their other mode. The mats of the sidewalk array also have end extensions 94 and 96 similar to end extensions 36 and 40 of the driveway mats, and the walkway mats 50'', 80, and 82 also have end extensions 94' and 96'.

The main mat 10, in one example of the invention, is 8 feet wide and 8 feet long, and has approximately 160 feet of hosing, with 32 T-section pipes and 3 elbows, with the parts interconnected by 103 clamps. For a two-car driveway, the width is doubled to 16 feet with all else remaining the same.

The driveway extension mat 50 is of the same dimensions as the main mat 10, and utilizes 30 T-section pipes and 4 elbows. The same amount of hosing is used as in the main mat.

The driveway mat 56 is also the same as the extension mat, but does not have any valves. The mixture of water and antifreeze is typically warmed to a temperature of a few degrees above the freezing point of water. Clearly, the temperature is dependent upon energy requirements, ambient conditions, and length of tubing used, and the types of material utilized.

Each of the sidewalk mats range in length from 8 feet to 14 feet, and in width from 4 feet to 5 feet. Each straight walkway mat ranges in length from 6 feet to 10 feet, and in width from 3 feet to 4 feet. The curved contoured mat is a 90 degree mat, but other angular contours may be provided and used, with a length thereof appropriate to the site. Further, curvature may be opposite to that shown for the mat 80 in FIG. 6.

The storage tank 66 also may provided in various sizes depending upon the area of road surface to be warmed. The heating element is preferably controlled automatically to keep the mixture at a constant temperature, which may be accomplished by well-known techniques. The T-section pipes are used for the mats and typically run about 3 inches in length. The ratio of antifreeze to water will, of course, vary depending upon the climate. For colder climates, more antifreeze will be needed.

The control equipment, such as the heating unit and pump, may be placed in a garage or cellar, with controls placed within the garage, cellar, or house for operating the entire system. Furthermore, the mats of the present invention may be used on any kind of outdoor surface, such as runways of airports, which will obviate the need for expensive snow-clearing and ice-clearing equipment presently used.

When not in use, the mats may be rolled up, or folded, as a conventional tarp, and stored on a large reel, or the like. Further, after all the ice and snow have been melted, the mats are rolled up, as a tarpaulin, and brought to a site where the water is drained and the mats dried. The reel used to mount and store the mats may also be provided with wheels for easy transport thereof.

While specific embodiments have been shown and described, it is to be understood that numerous changes and modifications may be made without departing from the scope and spirit of the invention, as set out in the appended claims.

What is claimed is:

1. A device for melting snow and ice on outdoor surfaces such as driveways, sidewalks, and walkways, comprising:

a first mat defining an interior chamber, said mat being substantially closed off about the circumference thereof, and comprising a plurality of concentrically-arranged tubes spaced apart in said interior chamber and mounted therein through which may flow a mixture for heating the surfaces of said first mat defining said interior chamber, each said tube having an inlet end and an outlet end;

an inlet manifold passageway with which each said inlet end and each said outlet end of said plurality of tubes is in fluid communication, so that mixture flowing through said inlet passageway flows through each of said plurality of tubes from each said inlet end thereof to each said outlet end thereof and back to said inlet passageway, said inlet passageway having a first intake end and a second outtake end, said inlet passageway also being mounted in said interior chamber;

a return-flow manifold passageway substantially parallel to said inlet manifold passageway and comprising a first intake end and a second outtake end;

a first interconnecting passageway having a first end in fluid communication with said outtake end of said inlet passageway and a second end in fluid communication with said intake end of said return-flow passageway, whereby the mixture may flow from said inlet passageway to said return-flow passageway;

a first valve positioned in said interconnecting passageway for controlling the flow of mixture therein;

a second interconnecting passageway having a first end in fluid communication with said outtake end of said inlet passageway, and a second end remote therefrom for fluid communication with an inlet passageway of another like-mat;

a second valve positioned in said second interconnecting passageway for controlling the flow of mixture from said outtake end of said inlet passageway to another like-mat;

a third interconnecting passageway having a first end in fluid communication with said intake end of said return-flow passageway, and a second end remote therefrom for fluid communication with the return-flow passageway of another like-mat; and a third valve positioned in said third interconnecting passageway for controlling the flow of mixture between adjoining return-flow passageways of two like-mats, whereby the flow of mixture through one or more mats may be selectively controlled.

2. The device according to claim 1, further comprising a second mat identical to said first mat, and having the said intake end of said inlet passageway thereof in fluid connection with said second end of said second interconnecting passageway, and having said outtake end of said return-flow passageway thereof in fluid connection with said second end of said third interconnecting passageway.

3. The device according to claim 2, further comprising a third mat having an inlet passageway and mounted at right angles with respect to each of said first and second mats, wherein each of said first and second mats comprises means adjacent said outtake end of said return-flow passageway for connecting said outtake end of said return-flow passageway to the intake end of the inlet passageway of said third mat.

* * * * *